US007236732B2

(12) United States Patent
Cao et al.

(10) Patent No.: US 7,236,732 B2
(45) Date of Patent: Jun. 26, 2007

(54) TONER IMAGE FIXING APPARATUS HAVING CONCENTRATED AREA HEATING

(75) Inventors: Jichang Cao, Lexington, KY (US); James D. Gilmore, Lexington, KY (US)

(73) Assignee: Lexmark International Inc., Lexington, KY (US)

( * ) Notice: Subject to any disclaimer, the term of this patent is extended or adjusted under 35 U.S.C. 154(b) by 221 days.

(21) Appl. No.: 11/042,018

(22) Filed: Jan. 25, 2005

(65) Prior Publication Data

US 2006/0165445 A1 Jul. 27, 2006

(51) Int. Cl.
*G03G 15/20* (2006.01)
*H05B 1/00* (2006.01)

(52) U.S. Cl. ..... 399/328; 219/216; 399/122

(58) Field of Classification Search ..... 399/107, 399/122, 320, 328, 329, 330, 331; 219/619, 219/216; 432/60
See application file for complete search history.

(56) References Cited

U.S. PATENT DOCUMENTS 3,452,181 A 6/1969 Stryjewski
3,953,709 A 4/1976 Elter
4,097,723 A 6/1978 Leitner et al.
4,163,892 A 8/1979 Komatsu et al.
5,011,401 A * 4/1991 Sakurai et al. ..... 432/60
5,499,089 A 3/1996 Tsukamoto et al.
5,528,351 A 6/1996 Tsuji
5,602,635 A 2/1997 Domoto et al.
5,774,763 A 6/1998 Muramatsu
5,866,875 A 2/1999 Okabayashi
5,933,695 A 8/1999 Henry et al.
6,498,911 B2 12/2002 Hiroki et al.
6,567,639 B1 5/2003 Murata et al.
6,975,829 B2 * 12/2005 Aruga ..... 399/329

OTHER PUBLICATIONS

U.S. Appl. No. 10/766,767, filed Jan. 28, 2004, Gilmore et al.

* cited by examiner

*Primary Examiner*—Hoan Tran
(74) *Attorney, Agent, or Firm*—Stevens & Showalter, LLP

(57) ABSTRACT

An apparatus is provided for fixing a toner image to a substrate including: a fixing member having a central axis and inner and outer surfaces; a heating element disposed within the fixing member for generating energy in the form of heat to heat the fixing member; and a back-up member cooperating with the fixing member to define a nip with the fixing member for receiving a substrate such that a toner image carried by the substrate is heated while in the nip. The heating element may have a center axis and be positioned near the fixing member inner surface such that the heating element center axis is spaced from the fixing member central axis.

19 Claims, 7 Drawing Sheets

TONER IMAGE FIXING APPARATUS HAVING CONCENTRATED AREA HEATING

TECHNICAL FIELD AND INDUSTRIAL APPLICABILITY OF THE INVENTION

The present invention relates to an apparatus for fixing a toner image to a substrate, wherein heat generated by a heating element within a fixing member may be concentrated on one or more desired sections of the fixing member.

BACKGROUND OF THE INVENTION

Toner image fixing apparatuses are known, wherein a heater lamp is centered within a fixing or heating roll in order to evenly heat an inner surface of the roll. Typically, heat transfer from the lamp to the roll is inefficient because the lamp is spaced far away from the roll inner surface. As a result, a long warm-up time occurs once the lamp is energized. Another disadvantage associated with a fixing roll having a centered heater lamp is axial temperature droop. This problem occurs as a result of non-uniform heating along the roll inner surface caused by the boundary effect of lamp filament heat distribution and heat losses at the ends of the roll due to conduction of heat energy into journals, bearings, bushings and drive gears, as well as heat energy losses at the roll ends due to convection and radiation.

One attempt at solving axial temperature droop involves providing a heater lamp having a boosted filament, which produces more heat at the ends than in the center of the lamp. Thin steel or aluminum fixing roll cores do not transfer heat energy well in the axial direction; hence, the temperature of the core ends near the boosted ends of the lamp may be significantly higher than that of the core center portion near the non-boosted center portion of the lamp. If a thicker roll is used in combination with a boosted filament, then warm-up time is delayed, which is problematic.

Still a further prior art fixing roll implementation involves providing a roll core which is thicker at its center portion and thinner at its ends. This roll core results in a delayed warm-up time once a corresponding heater lamp is activated. In addition, this roll core requires extra processing during its manufacture resulting in higher costs.

Accordingly, a toner image fixing apparatus is desired wherein warm-up time is minimized and axial temperature droop is reduced.

SUMMARY OF THE INVENTION

This need is met by the present invention, wherein an apparatus is provided for fixing a toner image to a substrate, wherein heat generated by a heating element within a fixing member may be concentrated on one or more desired sections of the fixing member inner surface. By doing so, it is believed that fixing member warm-up time is minimized and axial temperature droop is reduced.

In accordance with a first aspect of the present invention, an apparatus is provided for fixing a toner image to a substrate comprising: a fixing member having a central axis and inner and outer surfaces; a heating element disposed within the fixing member for generating energy in the form of heat to heat the fixing member; a sensor for sensing a temperature of said heating element and a back-up member cooperating with the fixing member to define a nip with the fixing member for receiving a substrate such that a toner image carried by the substrate is heated while in the nip. The heating element may be positioned near a first section of the fixing member inner surface, which section is located adjacent to the temperature sensor.

The heating element may have a center axis spaced from the fixing member central axis.

The fixing member may comprise a radius R extending from the central axis to the inner surface. The center axis of the heating element may be positioned approximately 0.3 R to about 0.6 R away from the central axis of the fixing member. Preferably, the center axis of the heating element is positioned approximately 0.44 R away from the central axis of the fixing member toward the first section of the fixing member inner surface.

The fixing member may comprise a heating roll. For example, the heating roll may comprise: a cylindrical core having an internal surface defining an internal passage for receiving the heating element, a silicone rubber layer provided over the core, and a PFA (polyperfluoroalkoxy-tetrafluoroethylene) layer provided over the silicone rubber layer. The PFA layer defines the outer surface of the fixing member. The internal surface of the cylindrical core also defines the inner surface of the fixing member.

The apparatus may further comprise a reflecting element disposed within the fixing member for reflecting energy in the form of heat generated by the heating element toward the fixing member inner surface first section. The reflecting element may be provided with a window for allowing energy in the form of heat to pass through the reflecting element window toward a second section of the fixing member inner surface spaced from the first section.

The back-up member may comprise a back-up roll. Alternatively, the back-up member may comprise a belt.

The heating element may comprise a lamp having a filament which is boosted at its end portions.

The first section of the fixing member inner surface may also be located adjacent to a substrate entry side of the nip.

In accordance with a second aspect of the present invention, an apparatus is provided for fixing a toner image to a substrate comprising: a fixing member having a central axis and inner and outer surfaces; a heating element disposed within the fixing member for generating energy in the form of heat to heat the fixing member; and a back-up member cooperating with the fixing member to define a nip with the fixing member for receiving a substrate such that a toner image carried by the substrate is heated while in the nip. The heating element may have a center axis and be positioned near the fixing member inner surface such that the heating element center axis is spaced from the fixing member central axis.

In accordance with a third aspect of the present invention, an apparatus is provided for fixing a toner image to a substrate comprising: a fixing member having inner and outer surfaces; a heating element disposed within the fixing member for generating energy in the form of heat to heat the fixing member; a back-up member cooperating with the fixing member to define a nip with the fixing member for receiving a substrate such that a toner image carried by the substrate is heated while in the nip; and a reflecting element disposed within the fixing member for reflecting energy in the form of heat generated by the heating element toward a first section of the fixing member inner surface. The reflecting element may be provided with a window for allowing energy in the form of heat to pass through the reflecting element window toward a second section of the fixing member inner surface spaced from the first section.

DETAILED DESCRIPTION OF THE PREFERRED EMBODIMENTS

Figure 1:
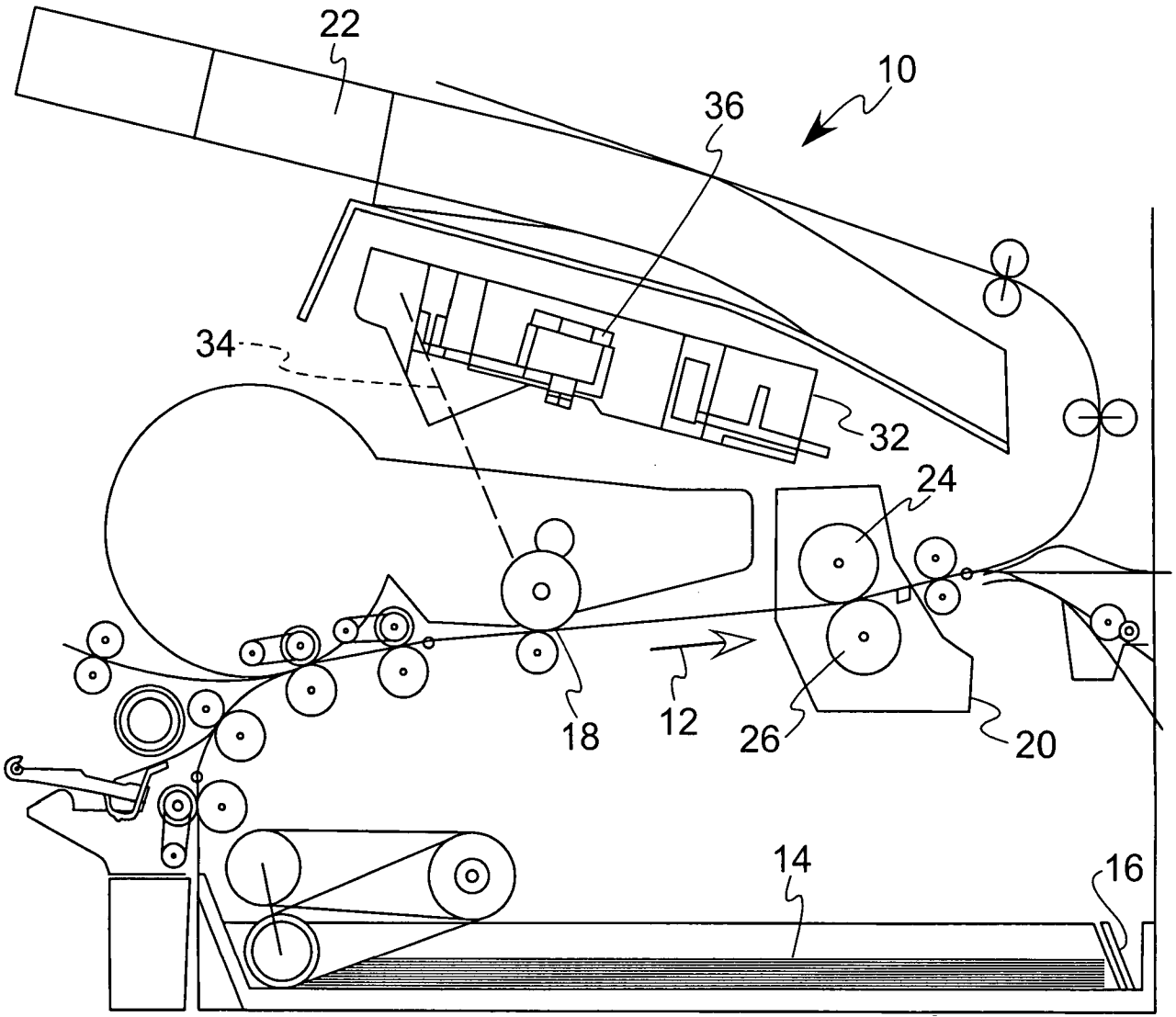
FIG. 1 is a schematic illustration of an electrophotographic printer including a fuser assembly constructed in accordance with a first embodiment of the present invention.

Referring to the drawings, and initially to FIG. 1 thereof, an electrophotographic printer 10 includes a media feed path 12 for feeding sheets of media or substrates 14, such as paper, from a media tray 16 past a photoconductive drum 18 and a fuser assembly 20 to an output tray 22. The fuser assembly 20, also referred to herein as "a toner image fixing apparatus," may include a fixing member comprising a heating roll 24, which is heated to fuse or fix toner images to the media sheets 14, and a backup member comprising a backup roll 26. Further provided is a sensor 97, a thermistor in the illustrated embodiment, for sensing the temperature of the outer surface 25 of the heating roll 24, see FIG. 3. A printhead 32 is disposed in the printer 10 for scanning the photoconductive drum 18 with a laser beam 34 to form a latent image thereon. A rotating polygonal mirror 36 redirects the laser beam 34 so that it ultimately sweeps the beam 34 across the photoconductive drum 18, thereby creating lines of print elements, also known as "Pels."

Figure 2:
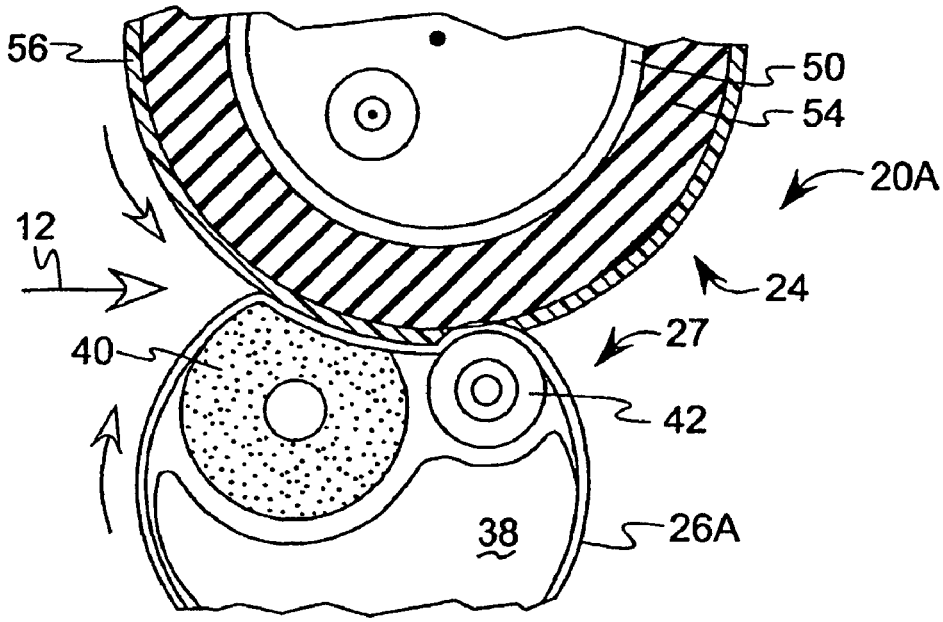
FIG. 2 is a side view of an alternative backup member.

Alternatively, a fuser assembly 20A may be provided having a backup member comprising a backup belt 26A, see FIG. 2, forming part of a backup belt assembly 27. The belt assembly 27 further comprises two nip forming rollers 40, 42 and a belt support member 38. A further discussion of the backup belt assembly is set out in copending patent application U.S. Ser. No. 10/766,767, entitled "BACKUP BELT ASSEMBLY FOR USE IN A FUSING SYSTEM AND FUSING SYSTEMS THEREWITH," filed on Jan. 28, 2004, the disclosure of which is incorporated by reference herein. The fuser assembly 20A may also include a fixing member comprising the fixing roll 24 illustrated in FIG. 1. The fuser assembly 20*a* may be used in place of the fuser assembly 20 illustrated in FIG. 1.

Figure 3:
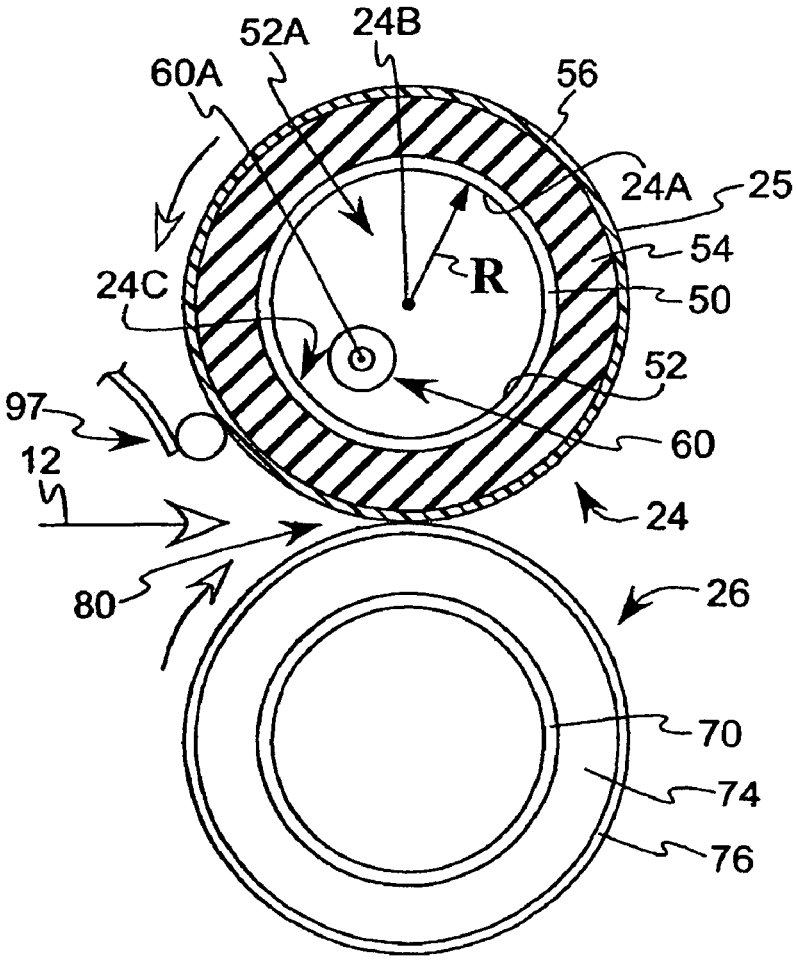
FIG. 3 is a side view of the fuser assembly illustrated in FIG. 1.

Referring now to FIG. 3, the heating roll 24 may comprise a cylindrical core 50 having an internal surface 52 defining an internal passage 52A for receiving a heating element 60. The internal surface 52 of the core also defines an inner surface 24A of the heating roll 24. A silicone rubber layer 54 is provided over the core 50, and a PFA (polyperfluoroalkoxy-tetrafluoroethylene) layer 56 is provided over the silicone rubber layer 54. The core 50 may be formed from steel having a thickness of from about 0.4 mm to about 0.7 mm and preferably about 0.5 mm. The silicone rubber layer 54 may have a thickness of from about 1.0 mm to about 2.5 mm and preferably about 1.5 mm. The PFA layer 56 may have a thickness of from about 30 microns to about 50 microns and preferably about 40 microns.

The backup roll 26 may comprise a cylindrical core 70. A silicone rubber layer 74 is provided over the core 70, and a PFA (polyperfluoroalkoxy-tetrafluoroethylene) layer 76 is provided over the silicone rubber layer 74. The core 70 may be formed from steel having a thickness of from about 0.4 mm to about 0.7 mm and preferably about 0.5 mm. The silicone rubber layer 74 may have a thickness of from about 1.0 mm to about 2.0 mm and preferably about 1.0 mm. The PFA layer 76 may have a thickness of from about 30 microns to about 50 microns and preferably about 40 microns.

As illustrated in FIG. 3, the heating roll 24 has a central axis 24B. The heating roll 24 also has a radius R extending from the central axis 24B to the inner surface 24A. Radius R may have a length of from about 13 mm to about 25 mm and preferably about 21 mm.

The heating element 60 may comprise a heater lamp with an internal filament. As schematically illustrated in FIG. 3, the heating element 60 has a center axis 60A, which may be spaced from the heating roll central axis 24B. For example, the center axis 60A of the heating element 60 may be positioned or spaced approximately 0.3 R to about 0.6 R away from the central axis 24B of the heating roll 24 toward the roll inner surface 24A and, preferably, about 0.44 R away from the central axis 24B of the heating roll 24. By positioning the heating element 60 off-axis within the roll 24, it is believed that heat transfer from the heating element 60 to the heating roll 24 occurs more efficiently so as to allow the heating roll 24 to heat up to a desired fixing temperature faster than in a conventional fusing assembly where the heater lamp is centered within the heating roll. It is also believed that a more uniform temperature distribution occurs along the length of the outer surface 25 of the roll 24.

In a preferred embodiment, the heating element 60 is positioned near a first section 24C of the heating roll inner surface 24A located adjacent to the thermistor 97. In the illustrated embodiment, the thermistor 97 is located adjacent to a substrate entry side of a nip 80 defined between the heating roll 24 and the backup roll 26. Typically, it is preferred to control the temperature of a heating roll by sensing the roll temperature at a location on the roll positioned near the substrate entry side of the nip defined between the heating roll and the backup roll. By positioning the heating element 60 near the thermistor 97, such that both the heating element 60 and the thermistor 97 are located in the preferred position adjacent to the substrate entry side of the nip 80, complexity of temperature control of the heating roll 24 at a location on the roll 24 positioned near the substrate entry side of the nip 80 via the heating element 60 is reduced. It is also contemplated that the heating element 60 may be positioned adjacent any other section of the heating roll inner surface 24A. However, it is preferred that the heating element 60 be positioned near the thermistor 97 adjacent the substrate entry side of the nip.

The heating element 60 is mounted in a fixed bracket outside journals or ends of the heating roll core 50 so as not to rotate with the core 50.

The heating element 60 may comprise a boosted filament, wherein the windings at opposing ends of the filament are of a greater density than those at the center portion of the filament. Preferably, the filament is boosted by 10%, i.e., each of the two opposing ends of the heating element operates at a 110% power level while the center portion operates at a 100% power level. The ends (not shown) of the core 50 may define opposing journals (not shown) having a large diameter so as to allow the heating element 60 to be positioned off-axis within the roll 24. For example, for a core 50 having a diameter of about 43 mm, the journals may have a diameter of about 37 mm. The added power output by the opposing ends of the heating element 60 is believed to compensate for heat energy losses due to the large diameter of the heating roll journals, i.e., heat energy losses at the heating roll ends due to convection and radiation, as well as losses due to conduction of heat energy into bearings, bushings and drive gears associated with the heating roll 24.

EXAMPLE 1

A fuser assembly comprising a heating roll and backup roll was provided. The heating roll comprised a 0.5 mm thick steel core, a silicone rubber layer provided over the steel core having a thickness of 1.5 mm and a PFA (polyperfluoroalkoxy-tetrafluoroethylene) layer provided over the silicone rubber layer having a thickness of about 40 microns. The heating roll had a radius R of about 21 mm, extending from the heating roll central axis to the heating roll inner surface. The backup roll comprised a 3.0 mm thick aluminum core, a silicone rubber layer provided over the core having a thickness of 1.0 mm and a PFA (polyperfluoroalkoxy-tetrafluoroethylene) layer provided over the silicone rubber layer having a thickness of about 40 microns.

During each of first, second and third test runs, a heating element with 10% boost was centered within the heating roll. For the first test run, a 500 W heating element was provided, for the second test run, a 765 W heating element was provided and for the third test run, an 895 W heating element was provided. During each test run, the heating roll was heated from 28° C. to 155° C. The time period for the heating roll to be heated from 28° C. to 155° C. was determined. The results from those tests are set out in Table 1 below.

Thereafter, fourth, fifth and sixth test runs were conducted. In each of those test runs, a heating element with 10% boost was provided within the heating roll. However, the heating element was moved within the roll toward a substrate entry side of a nip defined between the heating roll and the backup roll such that the center axis of the heating element was positioned approximately 0.6 R from the central axis of the heating roll. For the fourth test run, a 500 W heating element was provided, for the fifth test run, a 765 W heating element was provided and for the sixth test run, an 895 W heating element was provided. During each test run, the heating roll was heated from 28° C. to 155° C. The time period for the heating roll to be heated from 28° C. to 155° C. was determined. The results from those tests are also set out in Table 1 below.

TABLE 1

| Warm-up Time From 28 to 155 Degree C. | | | |
|---|---|---|---|
| Power (W) | Lamp at Center | Lamp at Entry Side | Reduction (%) |
| 500 | 34.5 Seconds | 25.7 Seconds | 25.5 |
| 765 | 24.1 Seconds | 17.85 Seconds | 25.9 |
| 895 | 21.1 Seconds | 15.55 Seconds | 26.3 |

Figure 4:
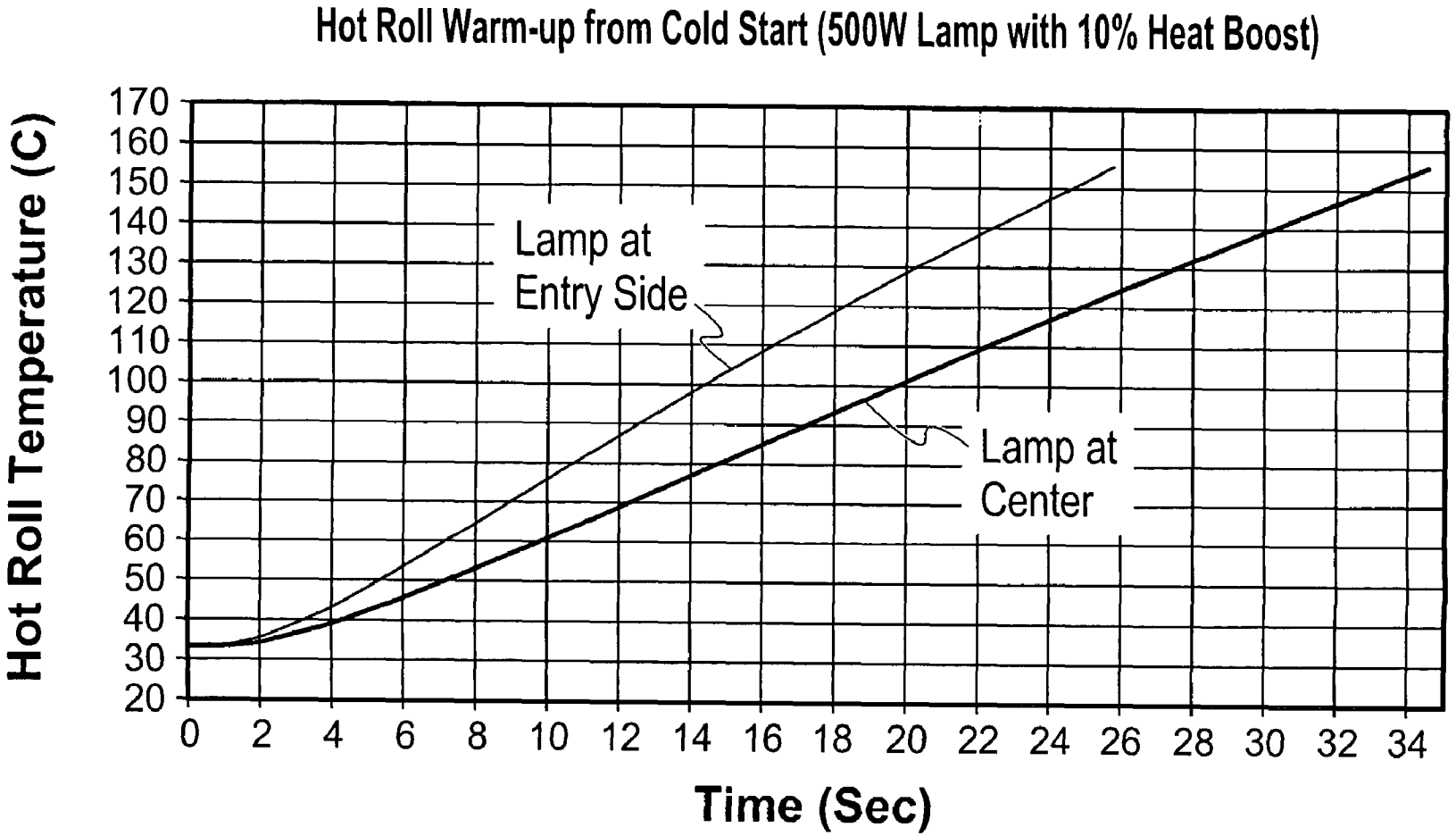
FIG. 4 illustrates a first curve comprising heating roll temperature vs. time data generated during a test run for a heating roll with the heating element centered within the roll and a second curve comprising heating roll temperature vs. time data generated during a test run for a heating roll with a heating element positioned near a substrate entry side of a nip defined between the heating roll and the backup roll.

As is apparent from Table 1, warmup time was reduced when the heating roll included a heating element positioned near the substrate entry side of the nip defined between the heating and backup rolls. See also FIG. 4, which provides first and second curves generated based on data gathered during the first and fourth test runs involving a 500 W heating element. As is apparent from FIG. 4, the heating roll, when provided with a heating element positioned near a substrate entry side of a nip defined between the heating roll and the backup roll, was heated at a rate that exceeded that of the heating roll when it included a centered or on-axis heating element.

EXAMPLE 2

A fuser assembly as described in Example 1 was provided. A 500 W heating element was centered within the heating roll. After the heating roll had been heated by its corresponding heating element, a plurality of temperature readings were taken at spaced apart points along the length of an outer surface of the heating roll. Those temperature data points are plotted in FIG. 5.

The 500 W heating element was then moved so as to be positioned near a substrate entry side of a nip defined between the heating roll and the backup roll. After the heating roll had been heated by its corresponding heating element, a plurality of temperature readings were taken at spaced apart points along the length of an outer surface of the heating roll. Those temperature data points are also plotted in FIG. 5.

Figure 5:
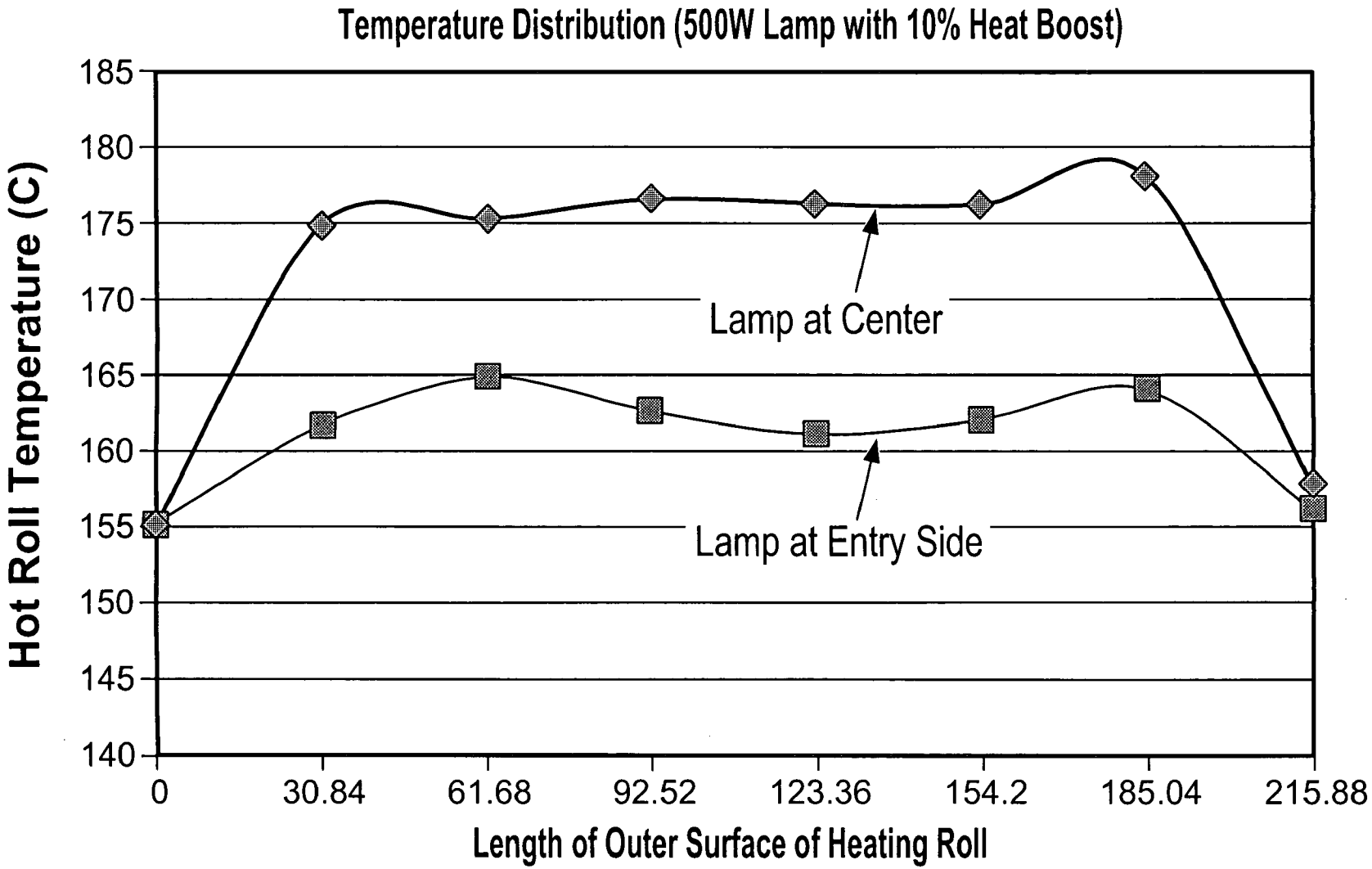
FIG. 5 illustrates a first curve generated from a plurality of temperature readings taken at spaced apart points along the length of an outer surface of a heating roll with a 500 W heating element centered within the heating roll, and a second curve generated from a plurality of temperature readings taken at spaced apart points along the length of an outer surface of a heating roll including a 500 W heating element positioned near the substrate entry side of the nip defined between the heating roll and the backup roll.

As is apparent from FIG. 5, when the heating element was positioned near the substrate entry side of the nip, temperature droop along the length of the outer surface of the roll, i.e., in the axial direction, was reduced. Hence, the axial temperature profile of the heating roll outer surface was more uniform.

By keeping the temperature profile along the length of a heating roll uniform, variations in gloss levels across a toned image fixed to a substrate may be reduced as well as occurrences of hot roll offset. Also, less energy may be required to maintain the heating roll at a desired elevated temperature.

Figure 6:
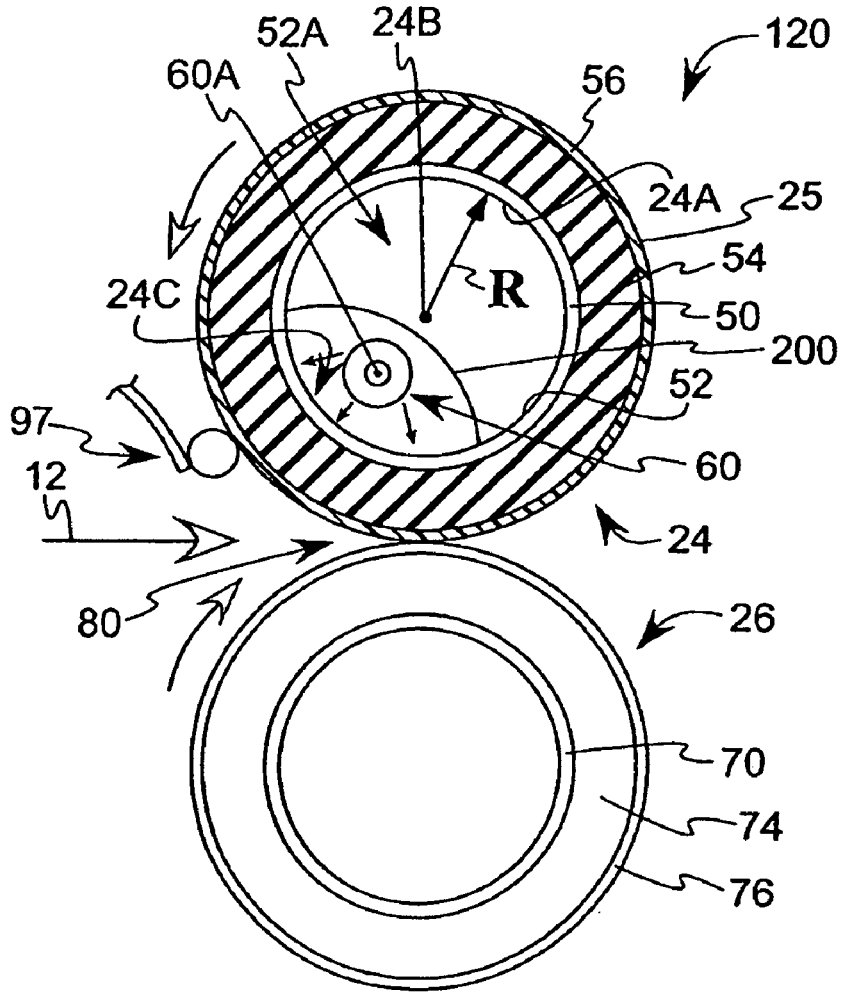
FIG. 6 is a side view of a fuser assembly constructed in accordance with a second embodiment of the present invention.
Figure 7:
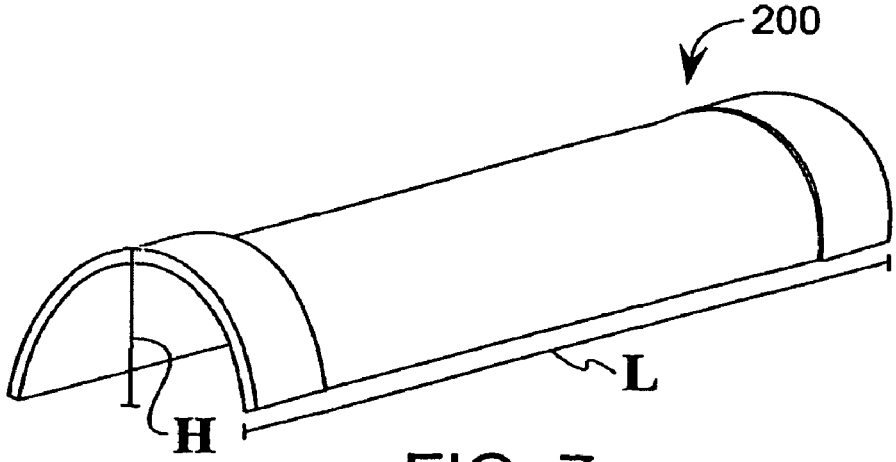
FIG. 7 is a perspective view of a reflecting element forming part of the fuser assembly illustrated in FIG. 6.

A fuser assembly 120 constructed in accordance a second embodiment of the present invention is illustrated in FIG. 6, wherein like reference numerals indicate like elements. In this embodiment, a reflecting element 200 is disposed within the core internal passage 52A so as to be positioned between the central axis 24B of the heating roll 24 and the roll inner surface 24A. The reflecting element 200 has a length L, see FIG. 7, such that it extends substantially along the entire length of the core internal passage 52A. The reflecting element 200 functions to reflect heat energy generated by the heating element 60 toward the heating roll inner surface first section 24C. It is believed that by focusing additional heat energy toward a section of the heating roll inner surface, heating roll warm-up time, e.g., from room temperature to a desired fixing temperature, occurs more quickly, i.e., the total time period to reach the desired fixing temperature is reduced. The reflecting element 200 may be formed from polished aluminum, copper or steel, and is mounted to the heating element bracket outside journals or ends of the heating roll core 50 so as not to rotate with the core 50.

Figure 8:
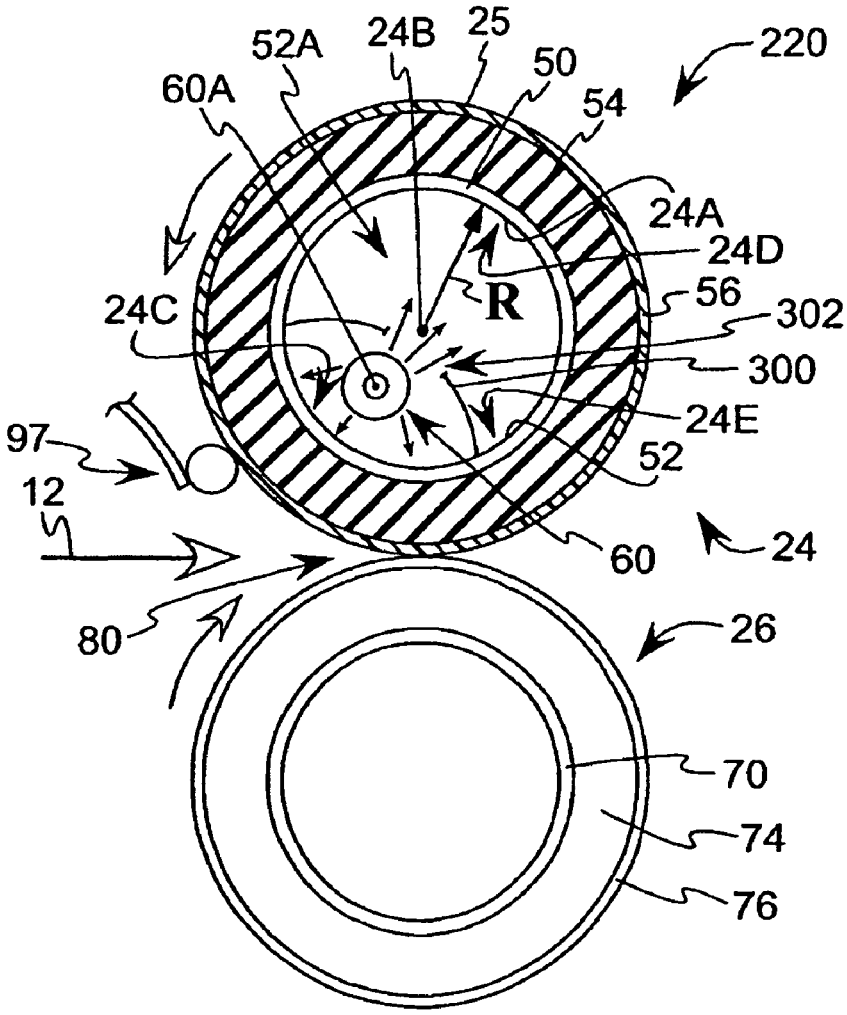
FIG. 8 is a side view of a fuser assembly constructed in accordance with a third embodiment of the present invention.
Figure 9:
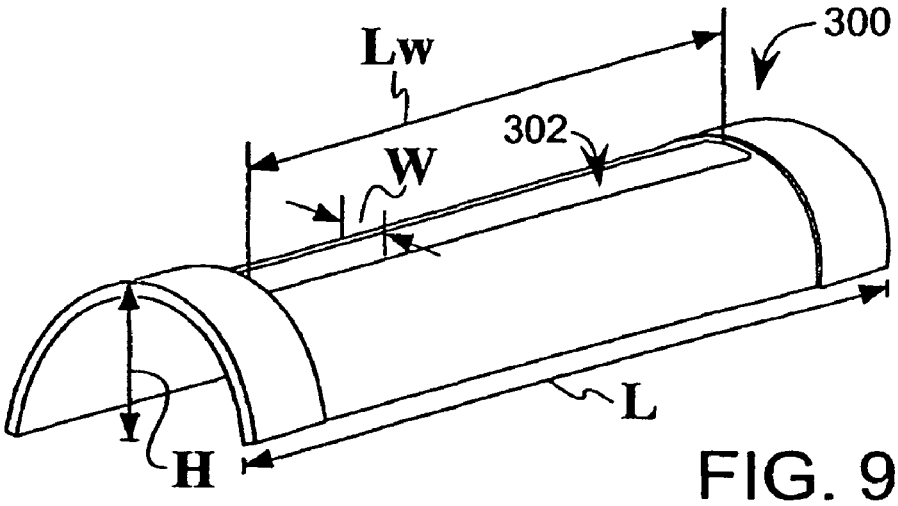
FIG. 9 is a perspective view of a reflecting element forming part of the fuser assembly illustrated in FIG. 8.

A fuser assembly 220 constructed in accordance a third embodiment of the present invention is illustrated in FIG. 8, wherein like reference numerals indicate like elements. In this embodiment, a reflecting element 300 is disposed within the core internal passage 52A so as to be positioned between the central axis 24B of the heating roll 24 and the roll inner surface 24A. The reflecting element 300 has a length L, see FIG. 9, such that it extends substantially along the entire length of the core internal passage 52A. The reflecting element 300 also includes a window or opening 302 having a width W and a length $L_W$. The reflecting element 300 functions to reflect heat energy generated by the heating element 60 toward the heating roll inner surface first section 24C. The window 302 allows a portion of the heat energy, e.g., radiation, which might otherwise be reflected by the reflecting element 300 to pass through the window 302 and be directed to a second section 24D of the heating roll inner surface 24A so as to increase the rate at which the second section 24D is heated. The location and size of the window 302 may be varied. For example, the window 302 may be positioned in the reflecting element 300 so as to direct heat energy toward a heating roll inner surface third section 24E which is positioned near a substrate exit side of the nip 80. The reflecting element 300 may be formed from polished aluminum, copper or steel, and is mounted via the heating element mounting bracket so as not to rotate with the heating roll 24.

EXAMPLE 3

A fuser assembly comprising a heating roll and a backup roll was provided. The heating roll comprised a 0.5 mm thick steel core, a silicone rubber layer provided over the steel core having a thickness of 1.5 mm and a PFA (polyperfluoroalkoxy-tetrafluoroethylene) layer provided over the silicone rubber layer having a thickness of about 40 microns. The heating roll had a radius R of about 21 mm, extending from the heating roll central axis to the heating roll inner surface. The backup roll comprised a 3.0 mm thick aluminum core, a silicone rubber layer provided over the core having a thickness of 1.0 mm and a PFA (polyperfluoroalkoxy-tetrafluoroethylene) layer provided over the silicone rubber layer having a thickness of about 40 microns.

During each of first, second and third test runs, a heating element with 10% boost was centered within the heating roll. No reflecting element was provided. For the first test run, a 500 W heating element was provided, for the second test run, a 765 W heating element was provided and for the third test run, a 895 W heating element was provided. During each test run, the heating roll was heated from 28° C. to 155° C. The time period for the heating roll to be heated from 28° C. to 155° C. was determined. The results from those tests are set out in Tables 2 and 3 below.

Thereafter, fourth, fifth and sixth test runs were conducted. In each of those test runs, a heating element with 10% boost was provided within the heating roll. However, the heating element was moved within the roll toward a substrate entry side of a nip defined between the heating roll and the backup roll such that the center axis of the heating element was positioned approximately 0.6 R from the central axis of the heating roll. Also, a reflecting element was provided within the core internal passage so as to be positioned between the central axis of the heating roll and the roll inner surface. The reflecting element had a length L=280 mm and height H=7.0 mm and included a window having a width W=6.0 mm, and a length $L_W$=240 mm, see FIG. 9. For the fourth test run, a 500 W heating element was provided, for the fifth test run, a 765 W heating element was provided and for the sixth test run, a 895 W heating element was provided. During each test run, the heating roll was heated from 28° C. to 155° C. The time period for the heating roll to be heated from 28° C. to 155° C. was determined. The results from those tests are set out in Table 2 below.

Seventh, eighth and ninth test runs were conducted. In each of those test runs, a heating element with 10% boost was provided within the heating roll. The heating element was positioned within the roll toward the substrate entry side of the nip such that the center axis of the heating element was positioned approximately 0.6 R from the central axis of the heating roll. Also, a reflecting element was provided within the core internal passage so as to be positioned between the central axis of the heating roll and the roll inner surface. The reflecting element had a length L=280 mm and a height H=7.0 mm, see FIG. 7. The reflecting element did not include a window. For the seventh test run, a 500 W heating element was provided, for the eighth test run, a 765 W heating element was provided and for the ninth test run, a 895 W heating element was provided. During each test run, the heating roll was heated from 28° C. to 155° C. The time period for the heating roll to be heated from 28° C. to 155° C. was determined. The results from those tests are set out in Table 3 below.

TABLE 2

| | Warm-up Time From 28 to 155 Degree C. | | |
|---|---|---|---|
| Power | Lamp at Center with no Reflector | Lamp at Entry Side and a Reflector with 6 mm Window | Reduction (%) |
| 500 W | 34.5 Seconds | 19.57 Seconds | 43.25 |
| 765 W | 24.1 Seconds | 13.3 Seconds | 44.8 |
| 895 W | 21.1 Seconds | 11.65 Seconds | 44.78 |

TABLE 3

| | Warm-up Time From 28 to 155 Degree C. | | |
|---|---|---|---|
| Power | Lamp at Center with no Reflector | Lamp at Entry Side and a Reflector with no Window | Reduction %) |
| 500 W | 34.5 Seconds | 17.56 Seconds | 49.1 |
| 765 W | 24.1 Seconds | 12.05 Seconds | 50 |
| 895 W | 21.1 Seconds | 10.7 Seconds | 49.3 |

As is apparent from Tables 2 and 3, heating roll warmup time was less for the heating roll when it included a reflecting element and had a heating element positioned near the substrate entry side of the nip defined between the heating and backup rolls as compared to the test runs where the heating element was centered within the heating roll and a reflecting element was not provided. Further, when comparing the data in Table 3 to that in Table 2, it appears that heating roll warm up time was reduced when the reflecting element was provided with no window.

EXAMPLE 4

Figure 10:
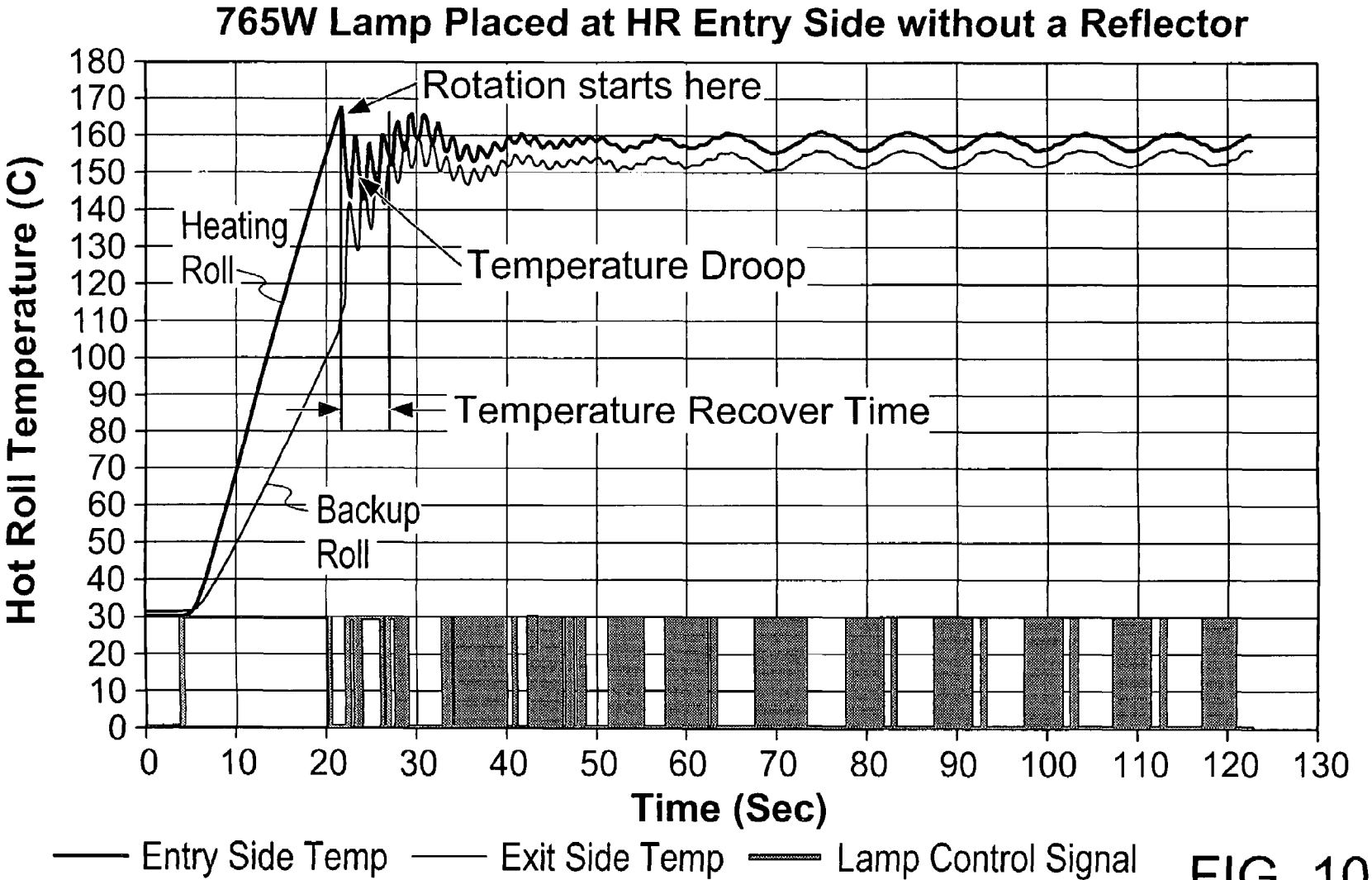
FIG. 10 provides a first curve illustrating heating roll warmup as measured by a thermistor positioned at an entry nip and a second curve illustrating warmup for the same heating roll as measured by a thermistor positioned at an exit nip.

A fuser assembly as described in Example 3 was provided. FIG. 10 provides a first curve illustrating heating roll warmup as sensed by a thermistor engaging an outer surface of the heating roll and being positioned near a substrate entry side of a nip defined between the heating roll and the backup roll and a second curve illustrating warmup of the same heating roll as sensed by a thermistor engaging an outer surface of the heating roll and being positioned near a substrate exit side of the nip. The heating roll included a 765 W heating element positioned near the substrate entry side of the nip. No reflecting element was provided. Initially, the heating and backup rolls were not rotated. Once the heating roll exceeded a temperature of about 160° C. as sensed by the thermistor positioned near the entry side of the nip, rotation of the heating and backup rolls was initiated. As is apparent from FIG. 10, it took approximately 18 seconds for the temperature of the heating roll to increase from about 30° C. to about 160° C., as sensed by the thermistor positioned near the entry side of the nip. Just after the heating and backup rolls began rotating, the temperature of the heating roll dropped approximately 20°, i.e., a temperature droop occurred. This temperature droop occurred due to the backup roll being initially at room temperature and a heating roll inner surface first section receiving an increased amount of the heat energy generated by the heating element once the heating element was energized. After initiation of the rotation of the heating and backup rolls, the temperature of the heating roll began to increase. After approximately 4 seconds, the temperature of the heating roll recovered to about 160° C., as sensed by the thermistor positioned near the entry side of the nip.

It is believed that for some heating roll designs, a time period required for the heating roll to warmup from a room temperature to a desired elevated temperature (including a recovery time to compensate for temperature droop) may be optimized by providing a window in a reflecting element. Hence, for a particular heating roll design, it is believed that one skilled in the art will be able to experimentally determine whether a reflecting element with no window or a reflecting element with a window of a given shape and size will result in the smallest possible warmup time period (including a recovery time) for the corresponding heating roll.

It is contemplated that the fuser assembly of the present invention may be incorporated into a color laser printer, such as a tandem color laser printer.

What is claimed is:

1. An apparatus for fixing a toner image to a substrate comprising:

a fixing member having a central axis and inner and outer surfaces;

a heating element disposed within said fixing member for generating energy in the form of heat to heat said fixing member;

a back-up member cooperating with said fixing member to define a nip with said fixing member for receiving a substrate such that a toner image carried by said substrate is heated while in said nip;

a sensor for sensing a temperature of said heating element; and said heating element being positioned near a first section of said fixing member inner surface located adjacent said temperature sensor.

2. An apparatus as set forth in claim 1, wherein said heating element has a center axis spaced from said fixing member central axis.

3. An apparatus as set forth in claim 2, wherein said fixing member comprises a radius R extending from said central axis to said inner surface, said center axis of said heating element is positioned approximately 0.3 R to about 0.6 R away from said central axis of said fixing member.

4. An apparatus as set forth in claim 3, wherein said center axis of said heating element is positioned approximately 0.44 R away from said central axis of said fixing member.

5. An apparatus as set forth in claim 1, wherein said fixing member comprises a heating roll.

6. An apparatus as set forth in claim 5, wherein said heating roll comprises:

a cylindrical core having an internal surface defining an internal passage for receiving said heating element, said internal surface of said cylindrical core also defining said inner surface of said fixing member;

a silicone rubber layer provided over said core; and a PFA (polyperfluoroalkoxy-tetrafluoroethylene) layer provided over the silicone rubber layer, said PFA layer defining said outer surface of said fixing member.

7. An apparatus as set forth in claim 1, further comprising a reflecting element also disposed within said fixing member for reflecting energy in the form of heat generated by said heating element toward said fixing member inner surface first section.

8. An apparatus as set forth in claim 7, wherein said reflecting element is provided with a window for allowing energy in the form of heat to pass through said reflecting element window toward a second section of said fixing member inner surface spaced from said first section.

9. An apparatus as set forth in claim 1, wherein said first section of said fixing member inner surface is located adjacent to a substrate entry side of said nip.

10. An apparatus as set forth in claim 1, wherein said back-up member comprises a belt.

11. An apparatus as set forth in claim 1, wherein said heating element comprises a lamp having a filament which is boosted at its end portions.

12. An apparatus for fixing a toner image to a substrate comprising:

a fixing member having a central axis and inner and outer surfaces;

a heating element disposed within said fixing member for generating energy in the form of heat to heat said fixing member;

a back-up member cooperating with said fixing member to define a nip with said fixing member for receiving a substrate such that a toner image carried by said substrate is heated while in said nip;

said heating element having a center axis and being positioned near said fixing member inner surface such that said heating element center axis is spaced from said fixing member central axis; and wherein said fixing member comprises a radius R extending from said central axis to said inner surface, said center axis of said heating element is positioned approximately 0.3 R to about 0.6 R away from said central axis of said fixing member.

13. An apparatus as set forth in claim 12, wherein said center axis of said heating element is positioned approximately 0.44 R away from said central axis of said fixing member.

14. An apparatus as set forth in claim 12, wherein said fixing member comprises a heating roll.

15. An apparatus as set forth in claim 12, further comprising a reflecting element also disposed within said fixing member for reflecting energy in the form of heat generated by said heating element toward said fixing member inner surface.

16. An apparatus as set forth in claim 12, wherein said heating element comprises a lamp having a filament which is boosted at its end portions.

17. An apparatus as set forth in claim 12, wherein said back-up member comprises a back-up roll.

18. An apparatus as set forth in claim 12, wherein said back-up member comprises a belt.

19. An apparatus for fixing a toner image to a substrate comprising:

a fixing member having inner and outer surfaces;

a heating element disposed within said fixing member for generating energy in the form of heat to heat said fixing member;

a back-up member cooperating with said fixing member to define a nip with said fixing member for receiving a substrate such that a toner image carried by said substrate is heated while in said nip; and a reflecting element disposed within said fixing member for reflecting energy in the form of heat generated by said heating element toward a first section of said fixing member inner surface, wherein said reflecting element is provided with a window for allowing energy in the form of heat to pass through said reflecting element window toward a second section of said fixing member inner surface spaced from said first section.

* * * * *